US005609957A

United States Patent [19]

Page et al.

[11] Patent Number: 5,609,957

[45] Date of Patent: Mar. 11, 1997

[54] FIBER

[75] Inventors: Stuart Page, Coventry; Paul L. Probert, Rugby, both of United Kingdom

[73] Assignee: Courtaulds plc, United Kingdom

[21] Appl. No.: 507,501

[22] PCT Filed: Feb. 24, 1994

[86] PCT No.: PCT/GB94/00370

§ 371 Date: Aug. 28, 1995

§ 102(e) Date: Aug. 28, 1995

[87] PCT Pub. No.: WO94/20653

PCT Pub. Date: Sep. 15, 1994

[30] Foreign Application Priority Data

Mar. 2, 1993 [GB] United Kingdom ..... 9304151

[51] Int. Cl.[6] ..... D02O 3/00

[52] U.S. Cl. ..... 428/372; 428/393; 536/56; 536/57

[58] Field of Search ..... 428/372, 393; 536/56, 57

[56] References Cited

U.S. PATENT DOCUMENTS

| | | | |
|---|---|---|---|
| 3,607,328 | 9/1971 | Rose | 106/166 |
| 3,630,114 | 12/1971 | Bunting et al. | 83/23 |
| 3,683,104 | 8/1972 | Woodland | 174/116 |
| 3,833,021 | 4/1974 | Rose et al. | 106/166 |
| 3,843,568 | 10/1974 | Woodland et al. | 174/116 |
| 3,899,452 | 8/1975 | Koch et al. | 106/189 |
| 4,007,248 | 2/1977 | Kostadinov et al. | 264/182 |
| 4,416,698 | 11/1983 | McCorsley, III | 106/163 R |
| 4,469,825 | 9/1984 | Kowalski et al. | 523/201 |
| 4,594,363 | 6/1986 | Blankenship | 521/64 |
| 4,880,842 | 11/1989 | Kowalski et al. | 521/64 |
| 4,970,241 | 11/1990 | Kowalski et al. . | |

FOREIGN PATENT DOCUMENTS

| | | |
|---|---|---|
| 342944 | 11/1989 | European Pat. Off. . |
| 1387265 | 3/1975 | United Kingdom . |
| 2008126 | 5/1979 | United Kingdom . |

OTHER PUBLICATIONS

New Collegiate Dictionary, ed. G. Bell & Sons, Ltd. and G. & C. Merriam Co., pp. 546 and 582 (1973).

"ROPAQUE OP–84 Emulsion", in Rohm and Haas (UK) Limited Material Safety Data Sheet (Dec. 4, 1988).

"Specialty Chemicals for the Paper Industry", in Rohm and Haas ROPAQUE Product Brochure (Dec. 1988).

H. Kon et al, "Delustered Synthetic Fibers", Chemical Abstracts, 107(26):87, Abstract No. 238496u (Dec. 28, 1987).

*Primary Examiner*—Newton Edwards

*Attorney, Agent, or Firm*—Howson and Howson

[57] ABSTRACT

Regenerated cellulosic fibers are delustered by the incorporation therein of hollow beads, suitably spherical beads of a diameter between 1.5 and 0.25 microns which have water permeable walls.

10 Claims, No Drawings

FIBER

BACKGROUND OF THE INVENTION

1. Field of the Invention

This invention relates to delustered regenerated cellulosic fibers and has particular, but not necessarily exclusive, reference to delustered regenerated cellulosic viscose rayon fiber.

2. Description of the Related Art

Regenerated cellulosic material may be produced by the well-known viscose rayon process which is described, for example, in the book "Man Made Fibers" by R.W. Moncrieff published by Heywood Books, London, England, Fifth edition 1970, pages 152 to 207. The term "viscose rayon" is also used herein to cover high tenacity cellulosic fibers, such as Modal fibers, and polynosic rayons, see Moncrieff pages 252 to 277. The contents of the two portions of the Moncrieff book are incorporated herein by way of reference.

More recently there has been commercialization.

In the viscose rayon fiber process as is described in Moncrieff a compound of cellulose —cellulose xanthate — is produced in an alkaline solution. The cellulose xanthate solution is then spun or extruded through a suitable jet into a regeneration bath to form filaments. Typically the regeneration bath contains sulphuric acid and other additives. In the regeneration bath the cellulose xanthate is converted into cellulose filaments. These filaments are cut to form staple fiber. Staple fibre is typically produced from jets with large numbers (tens of thousand or more) of individual holes.

More recently processes have been evaluated whereby cellulose is taken into a true solution in a solvent, such as an aqueous N-methyl morpholine-N-oxide and the solution of cellulose forms a dope which is extruded through a suitable jet into a spin bath, where the solvent is leached out to regenerate the cellulosic material. An example of such fiber is the recently available cellulose fiber which has been given the generic name lyocell by BISFA (The International Bureau for the Standization of Man-Made Fibres).

Although the viscose rayon production process is extremely well known and no further explanation need be provided of the process as such, the cellulose solution process is more recent. A suitable process for the production of lyocell cellulosic fiber is described in U.S. Pat. No. 4,416,698, the contents of which are incorporated herein by way of reference.

In many cases it is desirable to produce regenerated cellulose fiber which has a delustered appearance. Conventionally, such a delustered appearance has been provided by the incorporation of titanium dioxide into the dope to be spun to produce the fiber (see Moncrieff page 162). Titanium dioxide is an inert pigment which delusters the fiber very satisfactorily. Unfortunately, however, the production of titanium dioxide gives rise to potential pollution problems. Titanium dioxide is very abrasive and, further, may catalyze photodegradation of cellulose. This abrasiveness can lead to considerable wear in the manufacturing plant used to produce the regenerated cellulosic fiber and also in the plant used to process the fiber. In such circumstances, the titanium dioxide incorporated into the fiber acts as an abrasive or polish, abrading the equipment used to process the fiber. The disadvantages of titanium dioxide as well as the advantages, are described in Moncrieff pages 698 to 699, the contents of which are incorporated herein by reference.

Although there are problems with the use of titanium dioxide as a delustrant, on balance the benefits of the use of titanium dioxide are such that it is the most frequently used commercial delustrant, as far as the applicants are aware.

Numerous other materials have been proposed as delustrants for regenerated celluloses.

In U.S. Pat. No. 3,833,021 there is disclosed the use of droplets of colloidal size to act as a delustrant not for fibers but for regenerated cellulose sausage casings. In the description of the prior art in U.S. Pat. No. 3,833,021 there is an extensive summary of the delustrants which have been used previously in regenerated cellulose products. Thus U.S. Pat. No. 3,833,021 refers to the following earlier references; U.S. Pat. No. 1,951,094, said to disclose the use of metal soaps and emulsions; U.S. Pat. No. 1,822,416, said to disclose the use of ground cellulose particles; U.S. Pat. No. 2,034,771, said to disclose the incorporation of sulphur particles; U.S. Pat. No. 2,077,700, said to disclose the use of chlorinated organic materials; U.S. Pat. No. 2,021,863, said to disclose the use of various thiocarbonic esters; U.S. Pat. No. 2,227,495, said to disclose the use of turpines and turpene ethers; U.S. Pat. No. 1,922,952, said to disclose the incorporation of mineral oil and sulphonated oil; U.S. Pat. No. 1,902,529, said to disclose the use of waxes in viscose; U.S. Pat. No. 2,057,323, said to disclose the use of proteins; U.S. Pat. No. 3,042,702, said to disclose the use of silicate esters; U.S. Pat. No. 2,334,358, said to disclose the use of titanium oxide pigments; U.S. Pat. No. 1,819,241, said to disclose the use of wax in oil; U.S. Pat. No. 2,081,847, said to disclose the use of delustring agents in a volatile organic solvent, and U.S. Pat. No. 2,166,741, said to disclose the introduction of delustring agents in volatile organic solvents.

Other delustrants have been proposed as is described in Moncrieff page 698. In GB-A-2008126 there is disclosed the use of styrene polymers, preferably polystyrene. Fibers have also been produced from dope containing $Na_2CO_3$, which in turn results in gas evolution from sodium carbonate during spinning.

In East German Patent Specification (DD) 201,308 zinc compounds are added to provide a delustring effect. Zinc salts are also used to deluster synthetic fibers in accordance with the teachings of JP-A-48073600. In accordance with the teachings of JP-A-48006010 N-hexane-carbon tetrachloride has been used as a delustrant.

GB-A-1088012 describes the incorporation of opalescent particles or droplets in the extruded material to deluster films and filaments. U.S. Pat. No. 3,607,328 contains essentially the same text as U.S. Pat. No. 3,833,021 referred to above. In the official search on GB-A-2008126, the following references were cited GB-A-645954, GB-A-346793 and U.S. Pat. No. 4,007,248.

U.S. Pat. No. 3,899,452 describes a non-fibrous cellulosic film having enhanced rigidity obtained by the incorporation of from 1% to 25% of rigid hollow microspheres. GB-A-1387265 describes ion exchange celluloses particularly for ion exchange of large molecules, and refers to the incorporation of viscose solution into large diameter (¼ inch-6.4 mm) balls.

It can be seen from the above than extensive investigations have been made over many years to develop delustrants for cellulosic fibers. As mentioned above, however, none has really taken the place of titanium dioxide, which for all its problems, particularly those associated with the abrasive nature of the material, its adverse effect on the quality of dyeing and its adverse effect on photodegradation has proved to be the most satisfactory delustrant commercially.

It has now been discovered, however, that an alternative material to titanium dioxide may be used as delustrant for regenerated cellulosic fibers which has been found to give not only satisfactory properties in terms of the delustring of the cellulose fibers, without suffering from the disadvantages of the abrasive nature of titanium dioxide, but also improved photodegradation characteristics, a cleaner color to dyed delustered fibers when compared to titanium dioxide delustered fiber and a crisper dryer "hand" to fabric produced from such fiber.

SUMMARY OF THE INVENTION

By the present invention there is provided a delustered regenerated cellulose fiber wherein the fiber incorporates hollow beads.

The beads may be such that water will pass from the interior of the beads to the exterior. The walls of the beads may, therefore, be either discontinuous to permit water to pass from the interior to the exterior or the walls may be continuous but permeable to water. The beads may be substantially spherical.

Preferably, the beads have diameters in the range 0.1 microns to 1.5 microns, further preferably in the range 0.75 to 0.25 microns and further preferably in the range 0.4 to 0.6 microns. A preferred average diameter for the beads, preferably spherical beads, is 0.5 microns. A preferred material for the beads is an acrylic based material preferably "ROPAQUE" (trade mark) beads are used. The beads may be an styrene/acrylic copolymer.

Up to ten percent by weight of beads may be used, or even more if desired, although from 0.5% to 5% by weight of fiber is preferred, with 1% to 4% and 1.5% to 3.5% being further preferred.

The beads may be produced by any suitable method, for example, as described in U.S. Pat. Nos. 4,469,825; 4,594,363; 4,880,842 or 4,970,241, the contents of which are incorporated herein by way of reference.

The fiber may have a decitex in the range of 0.25 to 5 preferably 0.5 and further preferably 1.0 to 2.0. The fiber may be produced by the viscose process whereby a compound of cellulose is produced in an alkaline solution which forms a spinning dope or by the solvent spinning process whereby cellulose is dissolved as a true solution in a suitable solvent such as N-methyl morpholine N-oxide to produce a spinning dope. To the spinning dope is added hollow beads of a material which is substantially unreactive with the dope or with the solutions encountered during regeneration of the cellulosic material. By "substantially unreactive" is meant a material capable of withstanding the chemical, physical and thermal conditions of incorporation into the spinning dope, spinning, regeneration, and subsequent processing (including drying), so as to be capable of delustring the product at the end of the production process.

The hollow beads may be added in the form of a slurry to the dope and the slurry may be thoroughly mixed with the dope prior to spinning through a spinning jet to form the product. The cross-sectional shape of the fiber thus formed will be in part dictated by the shape of the jet holes through which the dope is extruded or spun. If the jet comprises one or more round holes then conventional fibers will be formed. If the jet holes are Y- or X-shaped in form then the fibers will have cross sections in the form of a Y or X, respectively. Because of the low abrasiveness of the preferred acrylic beads, it becomes possible to form such delustered fibers in this shape without causing unacceptable wear on the jet holes.

DESCRIPTION OF PREFERRED EMBODIMENT

By way of example, some embodiments of the present invention will now be described.

A delustrant comprising ROPAQUE beads, available as ROPAQUE OP84 from Rohm and Haas, being styrene/acrylic copolymer beads, having a particle size of 0.61 microns with a standard deviation of 0.09, was obtained as a 41 to 43% solid emulsion in water.

The raw material was vigorously mixed and diluted to 10% solids by water addition.

The thusly-diluted emulsion was injected into standard viscose during the mixing of viscose in a barrel mixer prior to filtering. An even and stable dispersion of the beads in the viscose was obtained and there was no evidence of jet blockage during spinning, when producing 1.7 decitex fiber.

it has been found that it is easier to use a diluted emulsion rather than injecting concentrated emulsion as it is necessary to use extremely vigorous mixing with the concentrated emulsion to give an even and stable dispersion of the beads in the spinning viscose.

The production of viscose fiber is well known, being fully described in the literature as outlined above. One of the advantages of the present invention is that the hollow beads may be incorporated into the viscose dope and spun into fiber without any changes being required to the conventional viscose production process.

1.7 decitex staple fiber containing two different levels of styrene/acrylic beads were produced, namely 4% by weight based on the dry weight of fiber and 2% by weight based on the dry weight of fiber.

To enable the effect of these additions to be determined, a comparative "dull control" product utilizing 1% by weight $TiO_2$ as a delustrant and a further sample referred to as the "bright control" (incorporating no delustrant) were produced.

The dull control sample containing 1% $TiO_2$ has a reasonably smooth surface. The sample containing 2% of styrene/acrylic beads was found to have small oval craters on its surface. The fiber containing 4% styrene/acrylic beads had small craters on its surface and additionally had a number of irregular lumps on the surface of the fiber. These appear to be a product of the styrene/acrylic particles just under the surface of the filament causing the outer cuticle to bulge.

Unexpectedly it has been found that this variation in surface gives rise to fiber which, when spun into yarn and woven into fabric, gives a crisper dryer "hand" to the fabric.

Each trial fiber was carded, fed through a draw frame and then open-end spun into 20/1 cotton count yarn.

Once the trial yarns had been produced, each was knitted up into tubes of about 10 cm diameter for evaluation of the fabric.

To the best of the applicants' knowledge, there is no reproducible standard test method for assessing luster. It was, therefore, necessary to rank the knitted fabric samples subjectively. A panel of 10 people ranked the four samples subjectively in order of luster, the most lustrous material was given the number 4 and the most delustered fiber was given the number 1.

When each of the 10 people had separately ranked the fabric samples, the rankings for each fiber were totalled to give resulting cumulative scores. These results are summarized in Tables 1 and 2 below. In each Table, the letter A represents the fiber having 1% $TiO_2$, letter B represents the fiber containing 4% styrene/acrylic beads, letter C represents the fiber containing 2% of styrene/acrylic beads and letter D represents the bright control the fiber containing no delustrant.

TABLE I

| BRIGHTEST → | | | DULLEST |
|---|---|---|---|
| 4 | 3 | 2 | 1 |
| D | A | C | B |
| D | A | C | B |
| D | A | C | B |
| D | A | C | B |
| D | A | C | B |
| D | C | B | A |
| D | C | B | A |
| D | C | B | A |
| D | B | C | A |
| D | B | A | C |

TABLE II

| | Cumulative |
|---|---|
| D = Bright Control | 40 |
| C = 2% ROPAQUE beads | 22 |
| B = 4% ROPAQUE beads | 17 |
| A = 1% Titanium dioxide dull control | 21 |

It will be appreciated that the fiber with the lowest score is the most delustered, and the fiber with the highest score is the most lustrous.

The results, particularly the cumulative score, indicate that the 2% hollow bead fiber is of a comparable mattness to the dull control fiber containing 1% $TiO_2$. The 4% hollow bead containing fiber is more delustered than the $TiO_2$-containing dull control fiber.

Visually, the fabric delustered with the hollow beads appeared less white than the dull control fabric delustered with $TiO_2$ or the bright control fabric.

Samples of each fabric were then tested to assess their susceptibility to ultra-violet light degradation. The samples of fabrics were exposed to UV light over continuous periods of 24 hours, and 6 days. Samples of fabric were tested for burst strength both before exposure, after 24 hours exposure, and after 6 days exposure.

The results are shown in Table 3 below.

TABLE III

| Sample | Original Burst Strength (kPa) | Burst Strength After 24 hours (kPa) | Burst Strength After 6 Days (kPa) |
|---|---|---|---|
| A | 300 | 300 | 280 |
| B | 260 | 280 | 280 |
| C | 285 | 325 | 285 |
| D | 240 | 285 | 250 |

It can be seen that there is no significant degradation in burst strength properties for fabric produced in accordance with the present invention. If anything the fabric in accordance with the present invention behaves more like the bright control fabric containing no delustrant rather than the dull control fabric containing 1% $TiO_2$ delustrant.

In a further series of tests (set out in Table IV) to quantify the UV stability of fabrics delustered in accordance with the invention, fabric strength was assessed by measuring breaking load in the fabric warp direction before and after 15 days exposure to UV.

Table IV indicates that the strength loss after 15 days continuous exposure to simulated sunlight is approximately 4 times greater for the dull control fabric containing $TiO_2$ than is the case for the non-delustered bright control fabric. Fabric containing 2% ROPAQUE retains the same strength as does the delustrant free bright control fabric. The results in Table IV are averages of 5 tests:

TABLE IV

| | BRIGHT | 1% $TiO_2$ | 2% ROPAQUE bead | 4% ROPAQUE bead |
|---|---|---|---|---|
| original break load (N) | 225 | 235 | 211 | 206 |
| extension (%) | 26.7 | 28.1 | 27.8 | 26.4 |
| break load after 15 days continuous exposure (N) | 214 | 189 | 201 | 185 |
| extension (%) | 25.0 | 25.7 | 28.4 | 26.3 |
| % loss in break load | 4.9 | 19.6 | 4.7 | 10.2 |

Because the existing commercially available matt fiber, incorporating $TiO_2$ is quite abrasive compared to normal undelustered fiber, it causes increased wear in fibre processing machinery, particularly rotor components in open end spinning travellers and guides in ring spinning and carding equipment components.

Tests were, therefore, carried out to compare the abrasion characteristics of fibre A containing 1% $TiO_2$ to the fibers B (4% ROPAQUE beads) and C (2% ROPAQUE beads) of the present invention. A comparative test with fiber containing no delustrants (Yarn D) was also arranged.

The measurement of abrasiveness of fibers in fabric form is extremely difficult. However, yarn quality measurement is possible by the use of a Constant Tension Transport Yarn Abrasion Tester (CTT-YAT). Equipment capable of carrying out such measurements is available from Lawson-Hemphill Sales of Spartanburg, S.C., USA. The CTT equipment capable of measuring yarn abrasion was introduced by Lawson-Hemphill Sales in 1991. Essentially in this test the yarn is pulled over a tensioned soft copper wire in a thread line between a tension arm and an output pulley guide. The yarn is pulled over the wire at a constant tension until the wire is cut through. The total length of yarn required to cut through the wire can then be compared to other yarns tested in the same way. Clearly in such a test the greater the length of the yarn required to sever the copper wire, the less abrasive the yarn is.

In a series of tests utilizing the CTT-YAT tester, a 30 AWG copper wire was utilized and tests were run to determine the number of meters of yarn necessary to sever the copper wire.

The results of these tests are shown in Table V below. In each case the yarn comprised a 20/1 cotton count open end spun yarn.

TABLE V

| Yarn Identification | Meters of Yarn to Sever a 30 AWG Copper Wire |
|---|---|
| Yarn A | |
| Sample 1 | 1619.9 |
| Sample 2 | 1742.6 |
| Average | 1681.3 |
| Yarn B | |
| Sample 1 | 3616.6 |
| Sample 2 | 4470.0 |
| Sample 3 | 4770.1 |
| Sample 4 | 4273.7 |
| Sample 5 | 3916.4 |
| Average | 4209.4 |
| Yarn C | |
| Sample 1 | 6357.4 |
| Sample 2 | 6264.4 |
| Sample 3 | 6713.9 |
| Sample 4 | 6445.1 |
| Sample 5 | 6544.7 |
| Average | 6465.1 |
| Yarn D | |
| Sample 1 | 25,284.1 |
| Sample 2 | 23,459.3 |
| Average | 24,371.7 |

It can be seen that yarn A, containing 1% $TiO_2$ required only 1681.3 meters on average to sever the copper wire. By comparison the yarn B, containing 4% of ROPAQUE hollow spheres, required on average over 4000 meters of yarn to severe the copper wire. Yarn C, the yarn containing 2% ROPAQUE hollow spheres, required on average over 6000 meters of yarn to sever the copper wire. Yarn D, the bright control yarn containing no delustrants required on average over 24000 meters of yarn to sever the copper wire. Thus the standard matt regenerated cellulose fiber containing 1% $TiO_2$ is over 14 times as abrasive as bright non-delustered yarn, in accordance with the results of this method of measurement. Even though the yarn containing 2% ROPAQUE beads is more abrasive than delustrant-free bright yarn, the yarn in accordance with the invention, which has almost exactly the same matt characteristics as the yarn containing 1% $TiO_2$ (see Table 2 above) is more than 380% less abrasive than the yarn containing 1% $TiO_2$.

Thus the present invention provides a fiber (yarn C) having a comparative mattness to the standard fiber (yarn A) of the prior art, whilst having virtually one quarter of its abrasiveness. Thus, on average, the tests set out above would appear to indicate that equipment used to process fiber in accordance with the present invention should last some 3.8 times longer than fiber of the prior art of approximately identical mattness.

The acrylic beads which were used are available from Rohm & Haas under the Trade Mark "ROPAQUE". The principal use of the beads is believed to be to provide a gloss to paper. It is believed than by using hollow beads, on drying of the fiber, water within the beads is evaporated off leaving small air pockets in the eventual fiber. The presence of the air pockets, having a different refractive index to the cellulose itself, gives rise to a matt delustered appearance to the fiber.

The "ROPAQUE" beads, when fully mixed with the viscose dope have been found to agglomerate less than $TiO_2$. This is of particular importance when making low decitex fiber (e.g. 1.3 decitex and below) or fibers of shaped cross section other than circular cross-section.

In addition to the incorporation of hollow beads into the fiber, a fibre optical whitener may be incorporated such as Novafil Violet-AR which may be used as an optical brightener of the type which converts ultraviolet light into optical light. Typically, the optical brightener may be incorporated at a level of 5 parts per million to the cellulose.

It has also unexpectedly been found that fabrics which have been formed from yarn produced by delustring the fiber in accordance with the invention exhibit a much cleaner color when dyed, particularly when dyed with dark colors, compared to fabrics formed from titanium dioxide delustered fiber. The presence of the $TiO_2$ in the fiber gives the fiber a chalky appearance compared to the fiber of the invention.

We claim:

1. Delustered regenerated cellulosic fiber, containing within the body of the fiber hollow beads, wherein said beads permit water to pass from the interior of the beads to the exterior.

2. The fiber according to claim 1, wherein said beads are substantially spherical.

3. The fiber according to claim 1 wherein the beads have a maximum averaged external diameter of 1.5 microns and a minimum averaged external diameter of 0.25 microns.

4. The fiber according to claim 3 wherein said beads are spheres having a diameter in the range of about 1.5 microns to 0.1 microns.

5. The fiber according to claim 1, wherein said beads are of an acrylic based material.

6. The fiber according to claim 1 wherein said fiber is regenerated cellulose viscose rayon fiber.

7. The fiber according to claim 4, wherein said diameter is in the range of 0.75 microns to 0.25 microns.

8. The fiber according to claim 4, wherein said diameter is in the range of 0.6 microns to 0.4 microns.

9. The fiber according to claim 4, wherein said diameter is in the range of about 0.5 microns.

10. The fiber according to claim 6, wherein said fiber has a decitex in the range 0.25 to 5.

* * * * *